US006947689B2

(12) United States Patent
Ikeda et al.

(10) Patent No.: US 6,947,689 B2
(45) Date of Patent: Sep. 20, 2005

(54) IMAGE FORMING APPARATUS

(75) Inventors: Taro Ikeda, Chiba (JP); Hiroyuki Sekine, Aichi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/687,813

(22) Filed: Oct. 20, 2003

(65) Prior Publication Data

US 2004/0213601 A1 Oct. 28, 2004

(30) Foreign Application Priority Data

Oct. 31, 2002 (JP) ..... 2002-317555

(51) Int. Cl.[7] ..... G03G 15/08

(52) U.S. Cl. ..... 399/227; 399/223; 399/226; 399/228; 399/265; 399/294; 399/286

(58) Field of Search ..... 399/227, 265, 399/294, 286, 228, 226, 223

(56) References Cited

U.S. PATENT DOCUMENTS 5,160,969 A * 11/1992 Mizuma et al. ..... 399/223
5,258,819 A * 11/1993 Kimura et al. ..... 399/119

FOREIGN PATENT DOCUMENTS

JP 11002961 A * 1/1999 ..... G03G/15/08
JP 2000-147900 5/2000
JP 2002351211 A * 12/2002 ..... G03G/15/08

* cited by examiner

*Primary Examiner*—Arthur T. Grimley
*Assistant Examiner*—Peter Lee
(74) *Attorney, Agent, or Firm*—Fitzpatrick, Cella, Harper & Scinto

(57) ABSTRACT

An image forming apparatus has a plurality of developing devices for developing an electrostatic image formed on an image bearing member, a rotary member holding the plurality of developing devices and rotated in a route including a developing position, the rotary member selectively positioning any one of the developing devices at the developing position, each of the plurality of developing devices having a first developer carrying member and a second developer carrying member for carrying a developer thereon and carrying it to the image bearing member, and a holding member holding the first developer carrying member and the second developer carrying member and pivotally movably provided.

2 Claims, 4 Drawing Sheets

IMAGE FORMING APPARATUS

BACKGROUND OF THE INVENTION

1. Field of the Invention

The invention relates to an image forming apparatus adopting an electrophotographic process or an electrostatic recording process, and particularly to an image forming apparatus such as a copying machine, a printer or a facsimile apparatus. More particularly, it relates to an image forming apparatus such as a copying machine, a printer or a facsimile apparatus capable of forming a full-color image.

2. Description of Related Art

In an image forming portion in an image forming apparatus such as a copying machine, a photosensitive member which is an image bearing member is charged by a charging apparatus, and is exposed to the image of an original at an exposure position by an exposing optical system to thereby form an electrostatic latent image on the peripheral surface of the photosensitive member, and this electrostatic latent image is developed by a developing apparatus to thereby form a developer image (toner image), and this toner image is transferred to a transferring material by the application of a voltage by a transferring apparatus, and the photosensitive member after the transfer is cleaned by a cleaning apparatus, whereafter exposure before charging is effected to thereby remove any residual charges on the photosensitive member, and the above-described process is repeated again to thereby effect image forming.

There has also been proposed an image forming apparatus which is provided with a plurality of photosensitive members, charging apparatuses and developing apparatuses and repeats the above-described image forming process a plurality of times to thereby form a full-color image.

Further, in the above-described image forming apparatus for forming a full-color image, it has heretofore been proposed to provide a plurality of developer carrying members (hereinafter referred to as the developing sleeves) in the developing apparatuses.

In this case, the developing sleeves are disposed with a predetermined clearance relative to the photosensitive members, but it is possible to form images of high definition at a high speed without greatly increasing the peripheral speed of the developing sleeves.

Also, in the black-and-white image forming apparatus of Japanese Patent Application Laid-Open No. 2000-147900 which has a developing device provided with a plurality of developing sleeves and fixedly disposed around a photosensitive member, there is proposed a method of pressing one developing sleeve against the photosensitive member with the other developing sleeve as a fulcrum.

The above-described full-color image forming apparatus, however, tends to become bulky, and has posed a problem in this point. That is, neither of the higher speed and higher quality of image and the downsizing of the image forming apparatus could be made compatible.

Also, it has been found by our studies that when supposing a construction in which a developing device provided with a plurality of developing sleeves is moved to a developing position by a rotary type developing apparatus to thereby effect developing, it is considered that when the rotary type developing apparatus is rotated, the developing sleeves interfere with the photosensitive member and therefore, it is difficult to highly accurately dispose the plurality of developing sleeves and the photosensitive member in proximity to each other.

SUMMARY OF THE INVENTION

It is an object of the present invention to provide an image forming apparatus which can make both of the higher speed of image forming and the downsizing of the image forming apparatus compatible.

It is another object of the present invention to provide an image forming apparatus which can make both of a higher quality of image in image forming and the downsizing of the image forming apparatus compatible.

It is another object of the present invention to provide an image forming apparatus in which the shock when a developer carrying member substantially abuts against an image bearing member can be reduced as much as possible.

Further objects of the present invention will become apparent from the following detailed description when read with reference to the accompanying drawings.

DETAILED DESCRIPTION OF THE PREFERRED EMBODIMENTS

Some embodiments of the present invention will hereinafter be described with reference to the accompanying drawings.

<First Embodiment>

Figure 1:
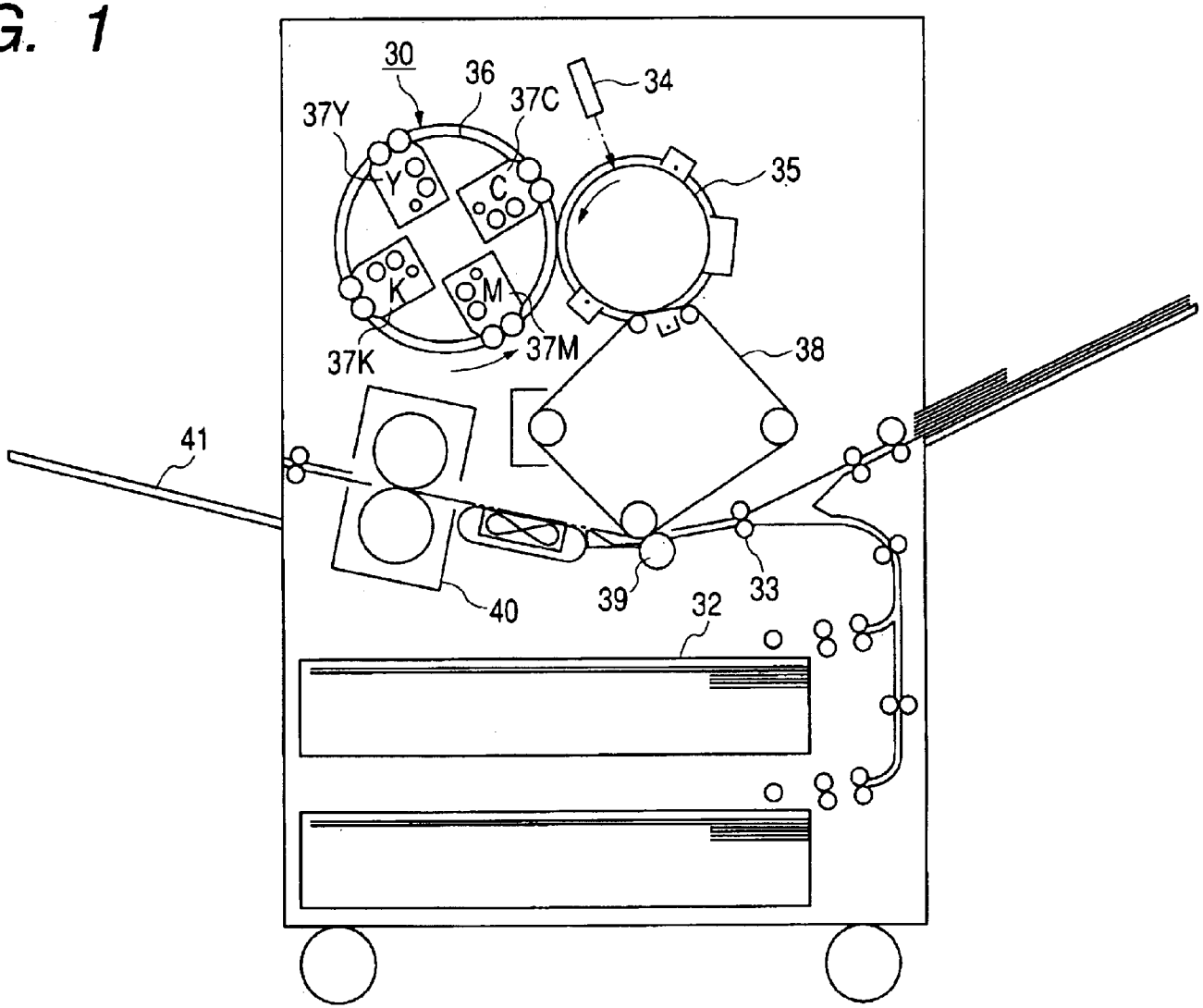
FIG. 1 is a schematic cross-sectional view of a full-color printer provided with a developing apparatus according to the present invention.

FIG. 1 is a schematic cross-sectional view of a full-color printer provided with a developing apparatus according to the present invention.

In the full-color printer of FIG. 1, the image information of an original read by an image reading portion (not shown) is processed by an image processing portion (not shown). For example, a recording sheet (not shown) fed from a cassette sheet feeding portion 32 has its skew feeding corrected at a registration portion 33 and comes to a secondary transferring portion 39.

On the other hand, the image data processed by the image processing portion (not shown) is recorded as a latent image on a photosensitive drum 35 as an image bearing member by a laser scanner portion 34. When a full-color image is to be formed, this latent image is developed by a rotary type developing apparatus 30 (rotary member). The rotary type developing apparatus 30 includes a plurality of (four) developing devices 37K(black), 37C(cyan), 37M(magenta) and 37Y(yellow) in a rotary containing portion 36, and develops the latent image on the photosensitive drum 35 as toner images of four colors while changing over these developing devices 37K, 37C, 37M and 37Y. The toner images of four colors are superimposed and primary-transferred onto an intermediate transferring belt 38, and the toner images on the intermediate transferring belt 38 are collectively transferred to the recording sheet at a secondary transferring portion 39. The toner image on the recording sheet is fixed on the recording sheet by a fixing portion 40, and the recording sheet having the toner image thereon fixed is discharged to a sheet discharging portion 41.

Description will now be made of the action of the rotary type developing apparatus 30 according to the present invention.

FIGS. 2 to 5 show the developing operation of the rotary type developing apparatus 30 provided with two developing sleeves. While for simplicity, a developing device 37 alone is taken as an example and the action thereof will hereinafter be described, the other developing devices are also similar in construction.

Also, the electrostatic image formed on the photosensitive drum 35 is adopted to be developed by a developing sleeve S1 and a developing sleeve S2 as developer carrying members which will be described later, in the named order.

Figure 2:
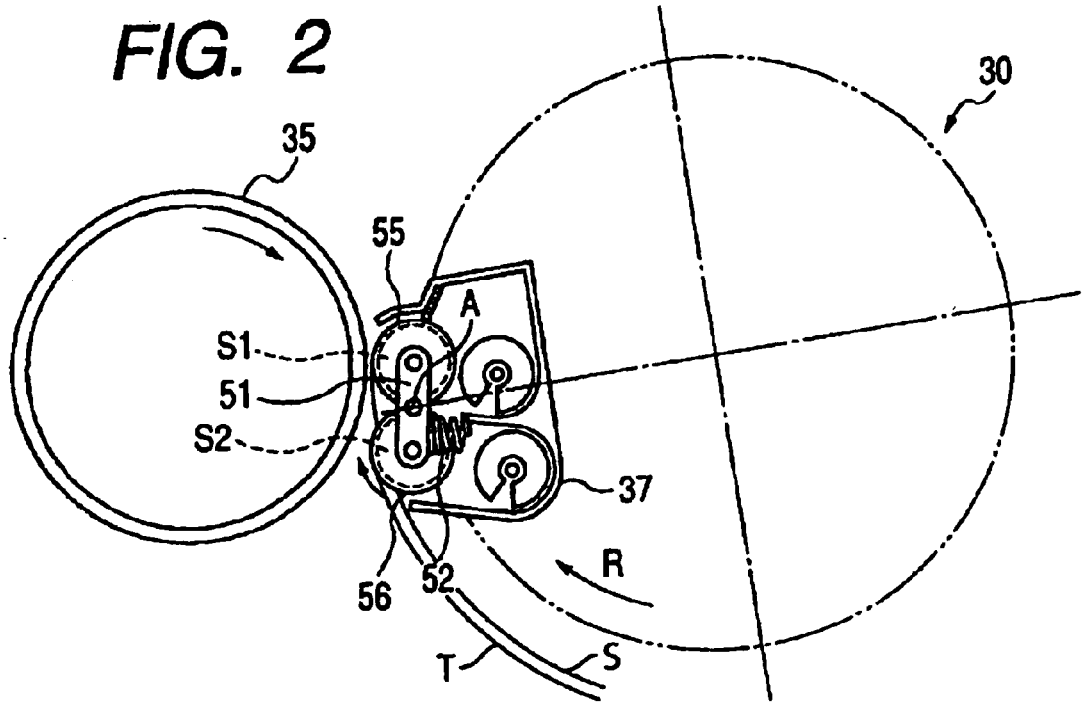
FIG. 2 is a cross-sectional view illustrating the developing operation of a developing apparatus according to a first embodiment of the present invention.

In FIG. 2, regulating members (abutting members) 55 and 56 for ensuring gaps (hereinafter referred to as the SD gaps) between the developing sleeves S1, S2 and the photosensitive drum 35 are mounted outside a developing area, often on the opposite end portions of the developing sleeves. Path S is the path of regulating member 55 and optical path T is the path of regulating member 56 during rotation in the direction R.

FIG. 2 shows a state in which the developing device 37 is being rotated without the developing sleeve S1 and the regulating member 55 on the upstream side with respect to the direction of rotation (the direction indicated by the arrow R in FIG. 2) of the rotary type developing apparatus 30 contacting with the photosensitive drum 35. The two developing sleeves S1 and S2 indicated by broken lines are pivotally connected together by a holding member 51 rotatable about a fulcrum A, and these are clockwisely pressed by a pressure spring 52 as biasing means.

Thus, as the developing device 37 is rotated in the direction indicated by the arrow R by the rotary type developing apparatus, the regulating member 56 first abuts against the photosensitive drum 35. When the rotation of the developing device 37 by the rotary type developing apparatus makes the contact between the two an occasion to progress further, the holding member 51 begins to rotate counter-clockwisely about a center of pivotal movement A (provided in the connecting portion between the developing sleeves S1 and S2) and finally, the regulating member 55 abuts against the photosensitive drum 35.

Figure 3:
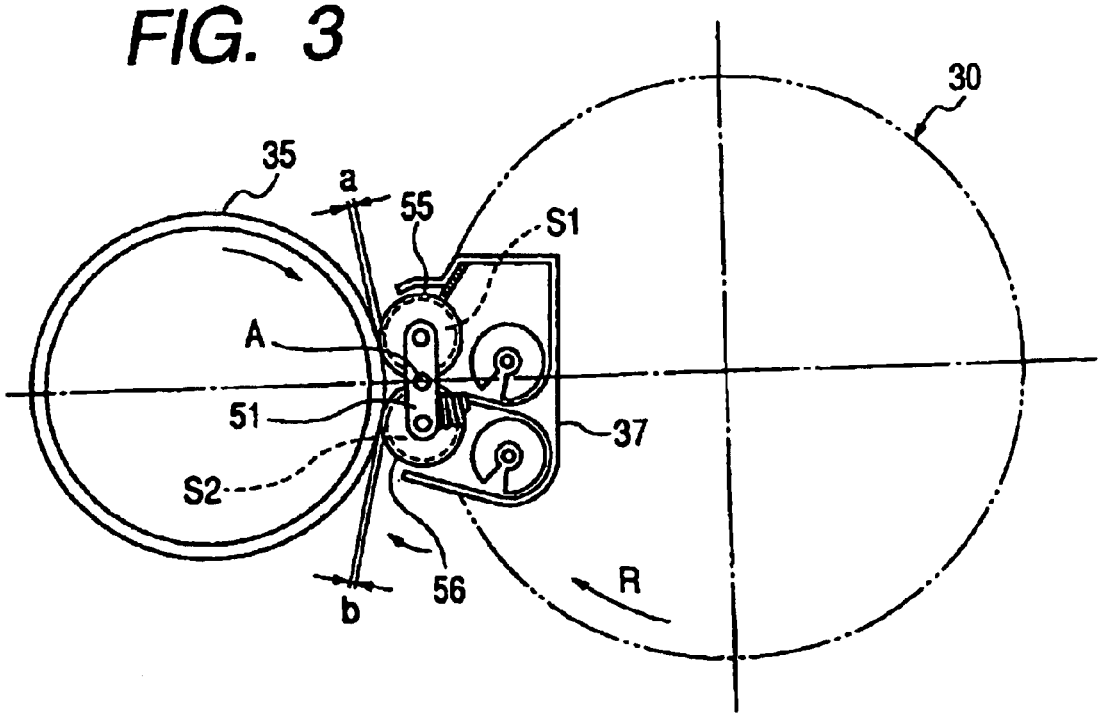
FIG. 3 is a cross-sectional view illustrating the developing operation of the developing apparatus according to the first embodiment of the present invention.
Figure 4:
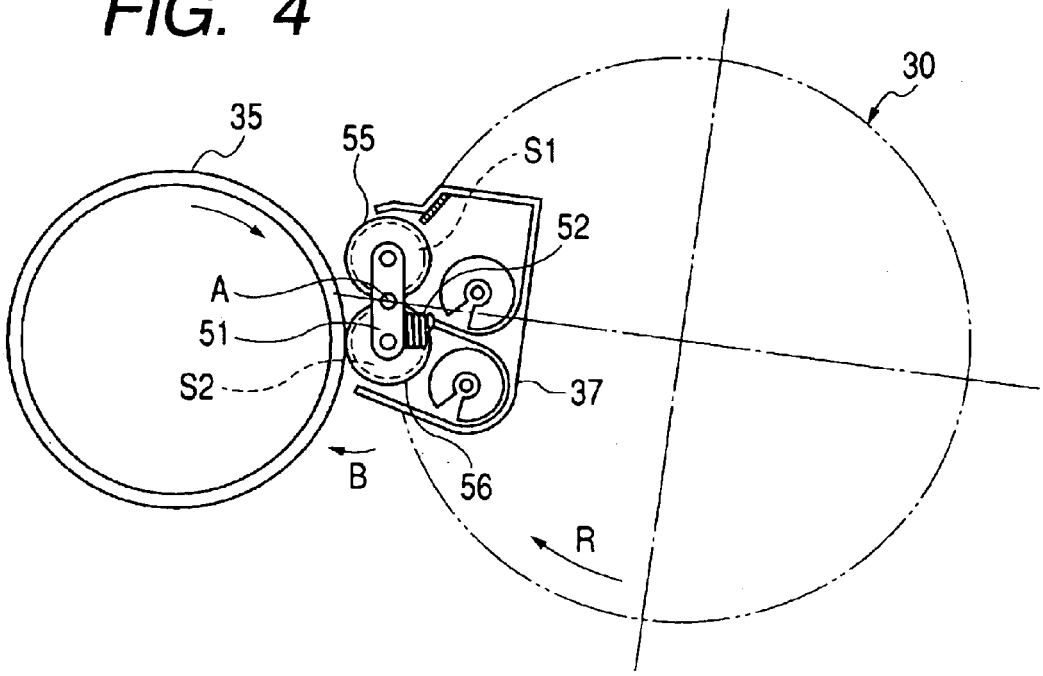
FIG. 4 is a cross-sectional view illustrating the developing operation of the developing apparatus according to the first embodiment of the present invention.

When the regulating members 55 and 56 provided on the developing sleeves S1 and S2, respectively, have both come to a developing position in which they abut against the photosensitive drum 35, as shown in FIG. 3, the developing device 37 stops its rotation and become capable of starting a developing operation for the photosensitive drum 35.

The regulating members 55 and 56 serve to abut against the outer peripheral surface of the photosensitive drum 35 and regulate the SD gaps between the developing sleeves S1, S2 and the photosensitive drum 35 to values "a" and "b", respectively, and these SD gaps "a" and "b" may be different values.

Figure 5:
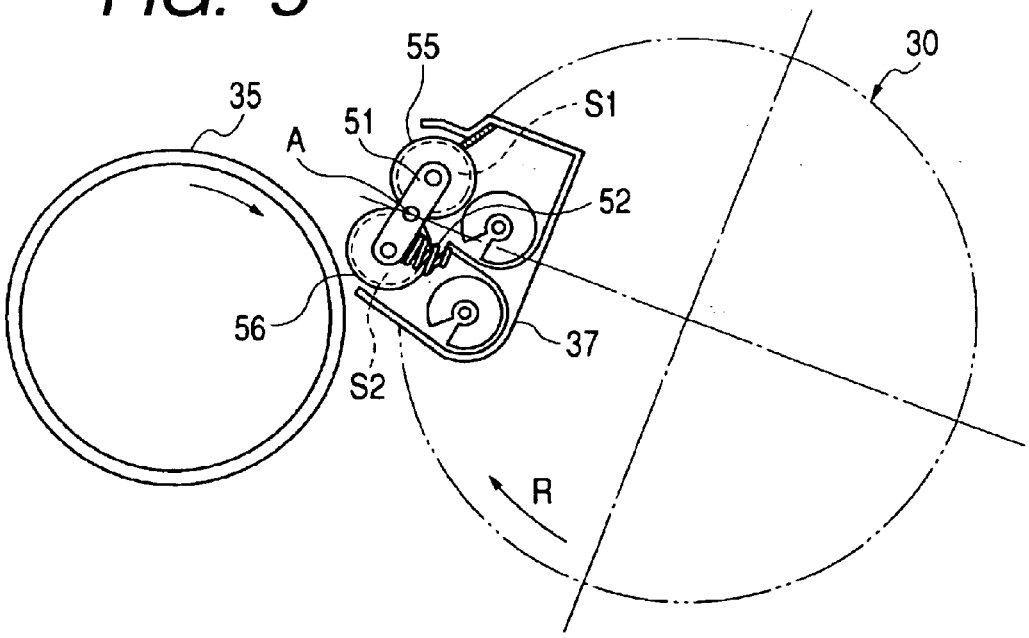
FIG. 5 is a cross-sectional view illustrating the developing operation of the developing apparatus according to the first embodiment of the present invention.

After the termination of developing, the developing device 37 is rotated by the rotary type developing apparatus and in operative association with the rotating operation thereof, the regulating member 56 of the developing sleeve S2 rotates about the center of pivotal movement A so as to move along the surface of the photosensitive drum 35. At this time, the holding member 51 is gradually moved in the direction indicated by the arrow B in FIG. 4 by the biasing force of the pressure spring 52. When the developing sleeve S2 separates from the photosensitive drum 35, the developing sleeves S1, S2 and the regulating members 55, 56 become completely spaced apart from the photosensitive drum 35, as shown in FIG. 5.

By the above-described operation, the positioning of the two developing sleeves S1 and S2 becomes possible and also, it becomes possible to successively dispose the developing sleeves S1 and S2 in proximity to the photosensitive drum 35.

Figure 6:
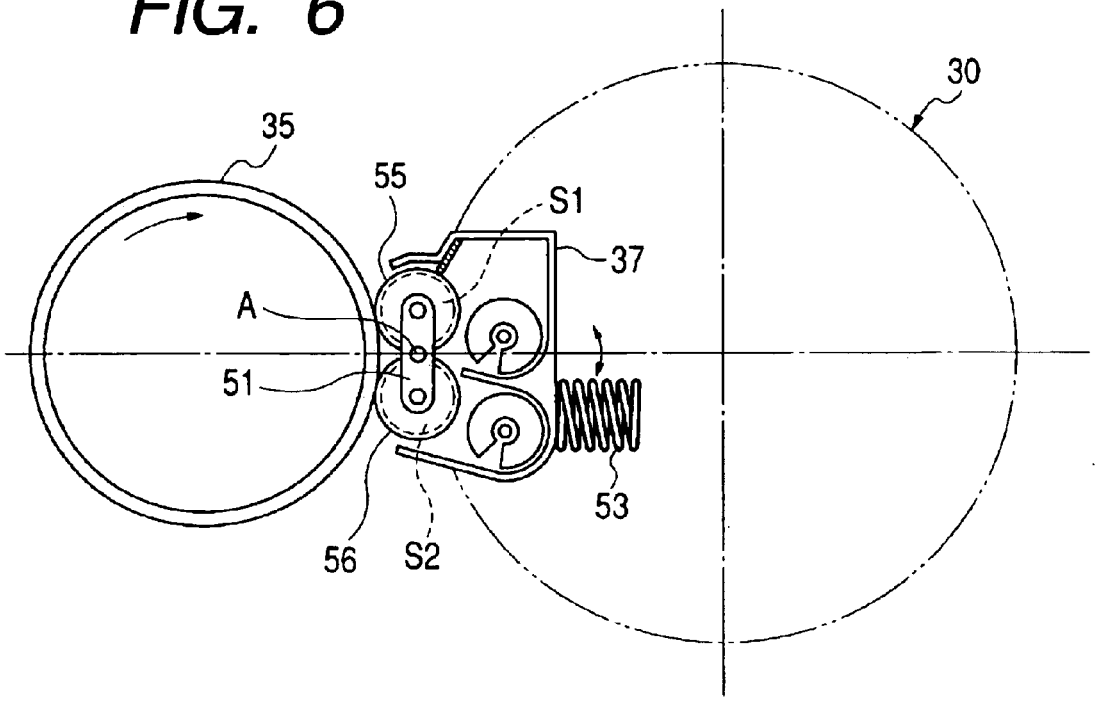
FIG. 6 is a cross-sectional view illustrating the developing operation of a developing apparatus according to a modification of the first embodiment of the present invention.

While in the present embodiment, description has been made of an example in which the developing sleeves S1 and S2 are rotated relative to each other, there may be adopted a construction as shown in FIG. 6 wherein the developing sleeves S1 and S2 are positioned in and fixed to the developing device 37 and the entire developing device 37 is pressed about a fulcrum A by a pressure spring 53 to thereby pivotally move the developing device 37. Again in this case, the regulating member 55 of the developing sleeve S1 can be made to pass without contacting with the photosensitive drum 35 earlier than the regulating member 56.

Also, while in the present embodiment, the vicinity of the developing sleeve S2 is pressed with the pressure spring 52 as a compression spring, the vicinity of the developing sleeve S1 may be pressed with the pressure spring 52 as a tension spring.

<Second Embodiment>

A second embodiment of the present invention will now be described.

Only the portions of the second embodiment which differ from the first embodiment will hereinafter be described.

Figure 7:
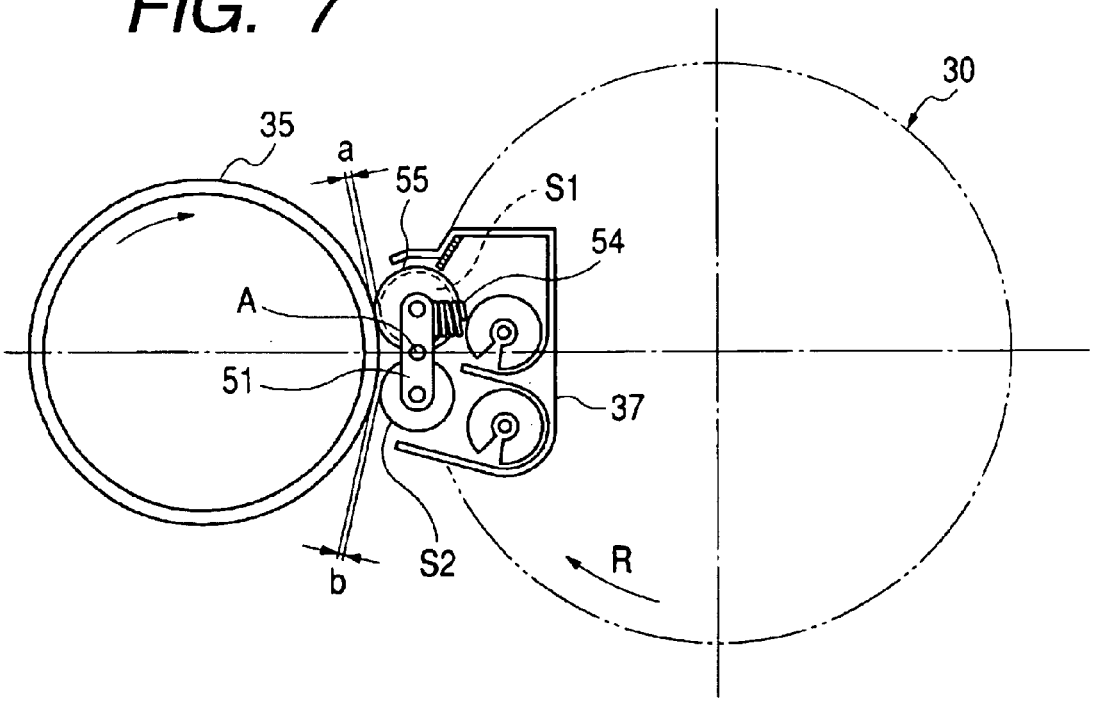
FIG. 7 is a cross-sectional view illustrating the developing operation of a developing apparatus according to a second embodiment of the present invention.

A positioning method for the developing sleeves in the present embodiment, as shown in FIG. 7, is to determine the positions of the developing sleeves S1 and S2 by utilizing the pivotally moving operation of the holding member caused by the regulating member 55 provided on the developing sleeve S1 on the upstream side with respect to the direction of rotation (the direction indicated by the arrow R in FIG. 7) of the rotary type developing apparatus 37 being hit against the photosensitive drum 35.

In FIG. 7, the developing sleeve S2 on the downstream side indicated by solid line is connected to the developing sleeve S1 by a holding member 51 counter-clockwisely pressed about a fulcrum A by a pressure spring 54, and this developing sleeve S2 is designed not to be hit against the photosensitive drum 35. The regulating member 55 of the developing sleeve S1 moves along the photosensitive drum 35, whereby the developing sleeve S2 is moved so as not to interfere with the photosensitive drum 35, and when the developing sleeve S2 comes to the developing position, developing is effected by the developing sleeve S2 with an SD gap "b" between it and the photosensitive drum.

Thus, again in the present embodiment, there is obtained an effect similar to that of the first embodiment.

While in the present embodiment, there is adopted a construction in which the developing sleeves S1 and S2 are pivotally moved by the holding member 51, again in the present embodiment, as in the first embodiment, there may be adopted a construction in which the developing device 37 is pivotally moved.

Now, the locations at which the first abutting shock of the developing sleeve against the photosensitive drum 35 occurs in the first embodiment and the second embodiment will be compared with each other.

It is the regulating member 56 of the developing sleeve S2 located downstream with respect to the direction of rotation of the rotary type developing apparatus 30 that first abuts in the first embodiment, and in the second embodiment, it is the regulating member 55 of the developing sleeve S1 located upstream with respect to the above-mentioned direction of rotation.

Here, the rotary type developing apparatus 30 is controlled so as to stop at a predetermined position via an acceleration section, a low speed section and a deceleration section after the start of rotation.

That is, it is more preferable for the developing sleeve to abut against the photosensitive drum when the rotational speed of the rotary type developing apparatus 30 has become approximate to the lowest possible speed, i.e., substantially zero.

Accordingly, if the developing sleeve on the downstream side with respect to the direction of rotation of the rotary type developing apparatus 30 first abuts against the photosensitive drum, the rotational speed of the rotary type developing apparatus 30 becomes approximate to substantially zero, and the abutting against the photosensitive drum is started at the timing whereat kinetic energy has become smaller, whereby the influence of the abutting shock against the photosensitive drum 35 can be made small.

From such a point of view, the first embodiment can be said to be a construction more desirable than the second embodiment.

As is apparent from the foregoing description, according to the above-described embodiments, both of the higher speed of image forming and the downsizing of the image forming apparatus can be made compatible.

Moreover, both of the higher quality of image in image forming and the downsizing of the image forming apparatus can be made compatible.

Further, the shock when the developer carrying member substantially abuts against the image bearing member with the rotation of the rotary member can be reduced as much as possible.

What is claimed is:

1. An image forming apparatus comprising:

a plurality of developing devices for developing an electrostatic image formed on an image bearing member;

a rotary member holding said plurality of developing devices for selectively moving any developing device to a developing position, wherein said rotary member starts a deceleration of a rotational speed of said rotary member before a selected developing device arrives at the developing position, wherein each of said plurality of developing devices includes a first developer carrying member and a second developer carrying member for developing the electrostatic image with developers carried by said first and second developer carrying members, respectively, and wherein said second developer carrying member is disposed upstream of said first developer carrying member in a rotating direction of said rotary member;

a first abutting member provided on said first developer carrying member for abutting against said image bearing member to ensure a distance between said first developer carrying member and said image bearing member; and a second abutting member provided on said second developer carrying member for abutting against said image bearing member to ensure a distance between said second developer carrying member and said image bearing member, wherein during a movement of the selected developing device to said developing position in association with a rotation of said rotary member, said second abutting member is brought into contact with said image bearing member, thereafter said first abutting member is brought into contact with said image bearing member, wherein said first developer carrying member and said second developer carrying member are fixedly disposed in each of said plurality of developing devices, and each of said plurality of developing devices is held pivotally movable with respect to said rotary member.

2. An image forming apparatus comprising:

a plurality of developing devices for developing an electrostatic image formed on an image bearing member;

a rotary member holding said plurality of developing devices for selectively moving any developing device to a developing position, wherein said rotary member starts a deceleration of a rotational speed of said rotary member before a selected developing device arrives at the developing position, wherein each of said plurality of developing devices includes a first developer carrying member and a second developer carrying member for developing the electrostatic image with developers carried by said first and second developer carrying members, respectively, and wherein said second developer carrying member is disposed upstream of said first developer carrying member in a rotating direction of said rotary member;

a first abutting member provided on said first developer carrying member for abutting against said image bearing member to ensure a distance between said first developer carrying member and said image bearing member; and a second abutting member provided on said second developer carrying member for abutting against said image bearing member to ensure a distance between said second developer carrying member and said image bearing member, wherein during a movement of the selected developing device to said developing position in association with a rotation of said rotary member, said second abutting member is brought into contact with said image bearing member, thereafter said first abutting member is brought into contact with said image bearing member, wherein during the movement of the selected developing device to the developing position, a distance between an outermost portion of said second abutting member and a rotation center of said rotary member is larger than a distance between an outermost portion of said first abutting member and the rotation center of said rotary member.

* * * * *